United States Patent [19]

Wallner et al.

[11] Patent Number: 4,776,285

[45] Date of Patent: Oct. 11, 1988

[54] PROCESS FOR GASIFYING FUELS WITH OXYGEN OR OXYGEN-CONTAINING GASES TO BE CARRIED OUT IN A SHAFT-LIKE FURNACE ARRANGEMENT

[75] Inventors: Felix Wallner; Adam Krier, both of Linz; Paul Freimann, St. Valentin, all of Austria

[73] Assignee: Voest-Alpine Aktiengesellschaft, Austria

[21] Appl. No.: 144,506

[22] Filed: Jan. 15, 1988

[30] Foreign Application Priority Data

Jan. 29, 1987 [AT] Austria ..... 177/87

[51] Int. Cl.[4] ..... F23G 5/12

[52] U.S. Cl. ..... 110/229; 48/76; 48/203; 110/341; 110/348

[58] Field of Search ..... 110/229, 230, 341, 348; 48/76, 203

[56] References Cited

U.S. PATENT DOCUMENTS 4,555,992 12/1985 Dutu et al. ..... 110/229
4,561,363 12/1985 Mallek ..... 110/229

FOREIGN PATENT DOCUMENTS 194252 4/1986 European Pat. Off. .
458879 4/1928 Fed. Rep. of Germany .
336356 10/1930 United Kingdom ..... 110/229

*Primary Examiner*—Edward G. Favors
*Attorney, Agent, or Firm*—Ostrolenk, Faber, Gerb & Soffen

[57] ABSTRACT

When gasifying fuels with oxygen in a shaft-like furnace adapted to receive solid charging stock and including a primary gas chamber on its lower end to be charged by at least one burner, a fixed bed is formed in the primary gas chamber by the charging stock. The charging stock is gasified by the hot offgases from the burner. The gas forming, upon passage through the fixed bed, is extracted from the furnace as a product gas. In order to keep the product gas free of impurities that constitue a load on the environment and limit its usability, such as tar and other higher hydrocarbons, an oxygen-containing gas is injected into the furnace space filled by the product gas and a slight portion of the product gas is burnt.

9 Claims, 2 Drawing Sheets

PROCESS FOR GASIFYING FUELS WITH OXYGEN OR OXYGEN-CONTAINING GASES TO BE CARRIED OUT IN A SHAFT-LIKE FURNACE ARRANGEMENT

The invention relates to a process for gasifying fuels with oxygen or oxygen-containing gases and optionally steam in a shaft-like furnace receiving solid charging stock and on whose lower end a primary gas chamber charged by at least one burner is provided, in which a fixed bed is formed by the charging stock, wherein the charging stock is gasified by the hot offgases from the burner and the gas forming is extracted from the furnace as a product gas upon passage through the fixed bed, as well as to an arrangement for carrying out the process.

With a process of this type (known, for instance, from DE-C No. 458 879) a substantial freedom of tar of the product gas is sought in order to be able to feed the product gas produced to further utilization without prior quenching. However, it is not always possible to observe a satisfactory tar freedom of the product gas, e.g., in case the solid charging stock has a high water content and/or a high content of volatile constituents.

The invention has as its object to further develop the initially described process with a view to freeing the product gas from impurities, such as tar or other higher hydrocarbons, which constitute a load on the environment and limit its usability.

In accordance with the invention, this object is achieved in that an oxygen-containing gas is introduced into the furnace space available above the fixed bed and filled with product gas, and only a slight portion of the product gas is burnt.

By burning a slight portion of the product gas, an increase in the temperature of the product gas to about 1,000° C. is feasible in a simple way. Since, as a rule, higher hydrocarbons are completely destroyed at a temperature of about 1,000° C. and a residence time of about 2 seconds, a satisfactory tar freedom of the product gas is guaranteed.

In order to provide for the temperature of the product gas that is necessary to destroy the higher hydrocarbons even with varying operational conditions, the temperature of the product gas preferably is measured in a product gas exhaust duct of the furnace, the oxygen-containing gas being fed in an amount being function of the temperature measured. In doing so, it is possible to ensure the high temperature of the product gas desired with as few deviations as possible by burning the least required volume portion of the product gas.

From EP-A No. 0 194 252, it is known to use low-grade fuels as the charging stock and to gasify the same to a high-grade product gas. According to a preferred variant of the process of the invention, possibly forming dioxins or furan-containing process products are avoided by providing an additional fixed bed behind the fixed bed of waste products formed by the charging stock to be gasified, which is covered by the charging stock to be gasified in the direction towards the primary gas chamber and through which the gas forming passes prior to being extracted, and that the oxygen-containing gas is introduced above the additional fixed bed and a slight portion of the product gas passed through the additional fixed bed is burnt.

By increasing the product gas temperature to about 1,000° C., the complete destruction of dioxins and furan-containing process products is, indeed, ensured.

To increase the temperature of the product gas to about 1,000° C. it will do to burn 0.5 to 8% by volume of the product gas within the furnace.

An arrangement for carrying out the process according to the invention, comprising a furnace to receive solid charging stock, a product gas exhaust duct provided on the upper end of a shaft-like compartment of the furnace, a primary gas chamber communicating with the shaft-like compartment of the furnace via a passage on its lower end and in which a burner including supply ducts for oxygen or oxygen-containing gases as well as for fuels and optionally steam is provided, and a supporting bottom arranged on the lower end of the furnace and including an overflow weir to accommodate slag, is characterized in that at least one gas feed for an oxygen-containing gas leads into the upper region of the shaft-like compartment of the furnace, in which gas feed a control valve is provided, which communicates with a temperature probe provided within the product gas exhaust duct via a control unit.

In order to guarantee a high product gas temperature in approximately the entire furnace space available above the fixed bed, the gas feed for the oxygen-containing gas preferably enters into the furnace via several orifices, which orifices are arranged to be distributed over the furnace periphery, preferably lying at different height levels of the furnace.

BRIEF DESCRIPTION OF THE DRAWINGS

The invention will now be explained in more detail by way of two embodiments and with reference to the accompanying drawings, wherein.

Figure 1:
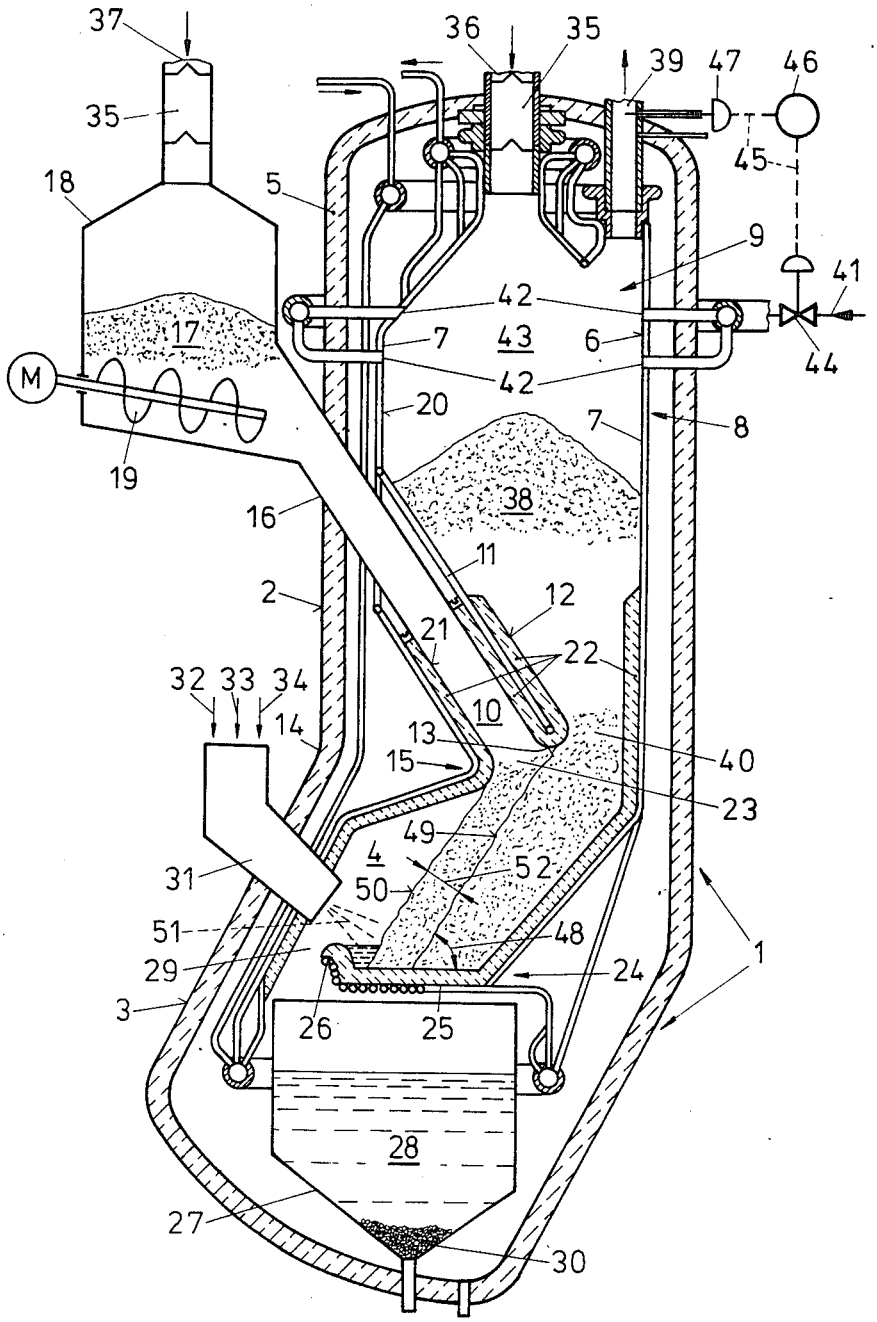
FIGS. 1 and 2 are each an embodiment of a shaft-like furnace in vertical section.

A furnace 1 comprises a vertical upper section 2, preferably having a circular cross section, and a lower section 3 laterally forming a knee and constituting a primary gas chamber 4. Since the furnace 1 can be operated either without pressure or under pressure, its outer shell 5 is designed accordingly, i.e., as a pressure vessel or as an ordinary gas-tight vessel.

Inside of the outer shell 5, there is provided a receptacle 8 designed as a cage and having cooled walls 6, in particular walls 6 composed of pipes 7 through which a coolant flows. To provide for two compartments 9, 10, the furnace 1 comprises a downwardly extending partition wall 12 provided with an internal cooling 11 and whose free lower edge 13 is disposed approximately at the height of the junction 14 of the knee-forming lower section 3 of the furnace 1 to its vertical section 2. At this level, the cage additionally comprises an inwardly extending projection 15, which forms the upper limitation of the primary gas chamber 4 arranged therebelow.

Into the compartment 10 of the furnace, there enters a supply duct 16 for the charging stock 17 to be gasified, which flows into the primary gas chamber 4 from a reservoir 18 connected to this supply duct 16, via a conveying means, such as a worm conveyor 19, by forming a bulk material bed. Departing from the burner-side wall 20 of the cage, the partition wall 12 is directed towards the primary gas chamber 4 obliquely downwards, preferably at an angle of 30° to 45°.

The charging stock 17 to be gasified passes through the supply duct 16 over a slide surface 21, which is cooled and provided with a refractory lining 22, as far as to the charging opening 23 that leads into the primary gas chamber.

The lower end 24 of the cage 8 is formed by an approximately horizontally directed supporting bottom 25, which also includes an internal cooling and whose free end reaching into the primary gas chamber is designed as a slag overflow weir 26. Below the supporting bottom 25, a trough 27 is provided, which is filled with coolant 28 for granulating the slag 30 passing over the overflow weir 26 and leaving the primary gas chamber 4 through a passage opening 29.

Above the slag overflow weir 26, a burner 31 enters into the primary gas chamber 4, into which burner supplies 32, 33, 34 for fuels, oxygen (or air) and optionally steam enter.

The cage 8 is coated on its inner side as far as to the level of the first third of its vertical part and its partion wall is coated on either side, with refractory material 22. The compartment 9 of the cage 8 and the reservoir 18, on their upper ends, each comprise supply openings 36, 37 for the charging stock 17 and 38, respectively, which are closeable by means of a sluice 35. The compartment 9 that is farther remote from the burner 31, near its upper end, is provided with an exhaust duct 39 for the product gas forming and leads into the primary gas chamber via a passage 40. The compartment 10 lying closer to the burner 31 joins the primary gas chamber via the charging opening 23 adjacent the passage 40.

A gas feed 41 for oxygen-containing gas leads into the upper third of the compartment 9 above the fixed bed formed by the charging stock 38 by means of several orifices 42 arranged to be distributed over the periphery of the furnace 1. Preferably, there are several orifices 42 disposed at different levels of the space 43 of the furnace 1 through which the product gas flows. In the gas feed 41, a control valve 44 is provided, which is in active communication with a temperature probe 47 provided in the product gas exhaust duct 39, via a control unit 46 incorporated in a control conduit 45.

The arrangement functions in the following manner:

At first, charging stock 38, in particular coke, is filled into the compartment 9 that is farther remote from the burner 31, with a bulk material bed forming as a function of the dumping angle 48 of the coke, which bulk material bed has a first dumping surface 49 directed to the burner 31. This dumping surface 49 departs from the lower edge 13 of the partition wall.

Subsequently, the charging stock 17 to be gasified is introduced into the compartment 10 of the cage lying closer to the burner 31, which charging stock 17 forms another bulk material bed covering the first bulk material bed and having a free dumping surface 50 facing the burner 31, a burner jet 51 being directed to the dumping surface 50.

The charging stock 17 to be gasified, which is introduced into the compartment 10 lying closer to the burner 31, may be of minor quality, for instance, brown coal, highly volatile hard coal, used tires or fuel from garbage. Upon ignition of the burner 31, this charging stock 17 is gasified, the steam contained in the charging stock participates in the gasifying reaction and higher hydrocarbons from pyrolysis are cracked and the crude gas forming is forced to penetrate the bulk material bed of, for instance, coke, arranged therebehind, due to the gas exhaust duct 39 being arranged in the compartment 9 that is farther remote from the burner 31. When passing through the coke, the crude gas is filtered such that the product gas leaving the compartment 9 exhibits a high purity.

It depends on the thickness 52 of the bulk material bed formed by the charging stock 17 to be gasified and on primary gasification control, whether the charging stock 38 disposed behind the second bulk material bed, e.g., the coke, also is gasified or merely serves as a filter for the throughgoing crude gas in the first place.

By feeding an oxygen-containing gas, such as, e.g., air, through the gas feed into the space 43 of the compartment 9 available above the fixed bed, one has succeeded in raising the temperature of the product gas, the temperature of the product gas being increased by about 100° C. when burning 30 $cm^3$ of crude gas. The control valve 44 regulating the oxygen-containing gas feed serves for the precise adjustment of a predetermined temperature of the product gas. This control valve 44, depending on the temperature of the product gas determined by the temperature probe 47, is opened more or less by the control unit 46, whereby more or less oxygen-containing gas gets into the space 43 and more or less volume portions of the product gas are burnt.

In the following, the gasification of low-grade fuel will be explained by way of an example:

Used oil and air are fed as fuel to the burner 31 and are burnt. Used tires are introduced as the charging stock 17 to be gasified; the fixed bed behind the charging stock 17 to be gasified, which is covered by the same in the direction towards the primary gas chamber 4, is formed by coke.

With the conventional process, i.e., without injection of an oxygen-containing gas into the space 43, the product gas extracted incurs in an amount of 2,000 $Nm^3/h$ and with a temperature of 890° C. Its analysis is indicated in Table I.

TABLE I

| Product gas analysis (without oxygen feed above the fixed bed) | | | |
|---|---|---|---|
| CO | $CO_2$ | $CH_4$ | $H_2$ |
| 33.6% by vol. | 6.6% by vol. | 2.6% by vol. | 25.8% by vol. |
| $H_2O$ | $N_2$ | $H_2S$, COS | |
| 10.4% by vol. | 20.6% by vol. | 0.4% by vol. | |

Tarry components were traced in the product gas, which are indications of a content of higher hydrocarbons, including dioxins.

In order to avoid dioxins and furan-containing process products, 66.9 $Nm^3/h$ of air are fed to the product gas defined in Table I within the furnace through gas feed 41. In doing so, the crude gas temperature rises to about 1,000° C. The amount of product gas is 2,055 $Nm^3/h$. The analysis of the product gas is indicated in Table II.

TABLE II

| Analysis of product gas (with oxygen feed above the fixed bed) | | | |
|---|---|---|---|
| CO | $CO_2$ | $CH_4$ | $H_2$ |
| 32% by vol. | 7.1% by vol. | 2.5% by vol. | 24.7% by vol. |
| $H_2O$ | $N_2$ | $H_2S$, COS | |
| 10.7% by vol. | 22.6% by vol. | 0.4% by vol. | |

The product gas is free of tarry components; for the purpose of analysis with regard to dioxins, furans and higher hydrocarbons, it was conducted through a gas purifying plant including a cyclone, a filter, a condensate separator and an ethylene glycol scrubber. Subsequently, the cyclone dust, the filter dust, the condensate and the ethylene glycol were analyzed in respect of dioxins, furans and higher hydrocarbons. It was found that in the cyclone dust less than 0.05 ppb (parts per billion, British system), in the filtered dust less than 0.07 ppb, in the condensate less than 0.9 ppt (parts per trillion, British system) and in the ethylene glycol less than 0.1 ppt of dioxins and furans were present. The content of higher hydrocarbons is below 10 ppt throughout.

The product gas produced in this way is free of dioxins, furan-containing process products and higher hydrocarbons.

Figure 2:
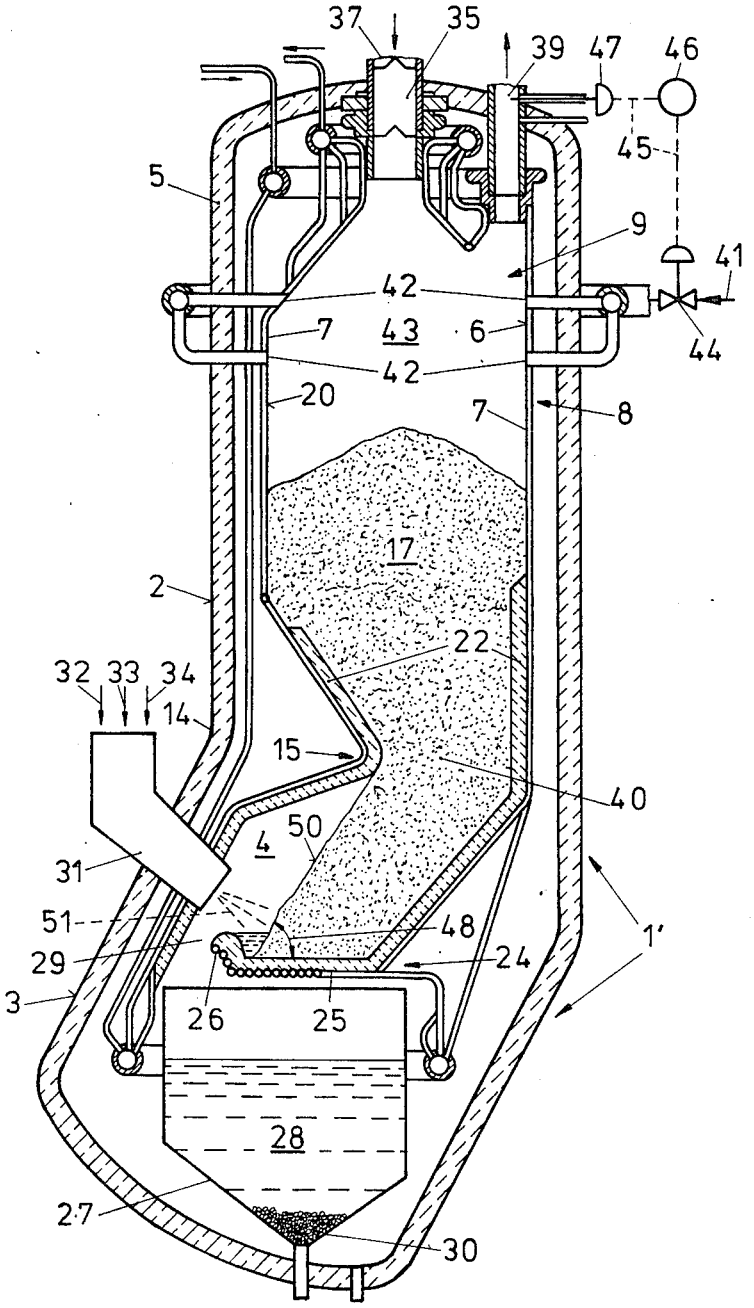

According to the embodiment illustrated in FIG. 2, the furnace 1' comprises just one compartment 9 in its vertical shaft part, into which the charging stock 17 to be gasified is charged. In respect of its remaining characteristic features, the furnace illustrated in FIG. 2 corresponds to that of FIG. 1. As the charging stock 17 to be gasified, coke or coal may, for instance, be charged.

The gasification of coal will be explained by way of the exemplary embodiment described in the following:

In the furnace 1', oil, coal, oxygen and steam are reacted to a product gas, wherein, at first, no oxygen is fed into the space 43 above the fixed bed, but oxygen is injected merely via the burner 31. The analysis of the product gas forming is indicated in Table III.

TABLE III

Analysis of product gas (without oxygen feed above the fixed bed)

| CO | $CO_2$ | $CH_4$ | $H_2$ |
|---|---|---|---|
| 41.9% by vol. | 9.4% by vol. | 1.1% by vol. | 36.6% by vol. |
| $H_2O$ | $N_2$ | $H_2S$, COS | |
| 7.0% by vol. | 3.6% by vol. | 0.4% by vol. | |

Tarry components were traced in the product gas, which are indications of a content of higher hydrocarbons, including dioxins.

The product gas incurs in an amount of 1,876 $Nm^3/h$ with a temperature of 754° C.

In order to keep the product gas free of tar, air is blown in through the gas feed 41 above the fixed bed in an amount of 186 $Nm^3/h$, the product gas temperature thereby rising to about 1,000° C.; the product gas incurs in an amount of 2,025 $Nm^3/h$; its analysis is indicated in Table IV.

TABLE IV

Analysis of product gas (with oxygen feed above the fixed bed)

| CO | $CO_2$ | $CH_4$ | $H_2$ |
|---|---|---|---|
| 36.9% by vol. | 10.7% by vol. | 1.0% by vol. | 32.2% by vol. |
| $H_2O$ | $N_2$ | $H_2S$, COS | |
| 8.3% by vol. | 10.6% by vol. | 0.3% by vol. | |

The product gas is free of tarry components; for the purpose of analysis with regard to dioxins, furans and higher hydrocarbons, it was conducted through a gas purifying plant including a cyclone, a filter, a condensate separator and an ethylene glycol scrubber. Subsequently, the cyclone dust, the filter dust, the condensate and the ethylene glycol were analyzed in respect of dioxins, furans and higher hydrocarbons. It was found that in the cyclone dust less than 0.05 ppb, in the filtered dust less than 0.07 ppb, in the condensate less than 0.9 ppt and in the ethylene glycol less than 0.1 ppt of dioxins and furans were present. The content of higher hydrocarbons is below 10 ppt throughout.

The product gas thus obtained is free of tar and other higher hydrocarbons.

What we claim is:

1. In a process for gasifying fuels with oxygen or oxygen-containing gases and optionally steam to be carried out in a shaft-like furnace arrangement adapted to receive solid charging stock and including a primary gas chamber on its lower end to be charged by at least one burner, wherein:

a fixed bed is formed by said charging stock in said primary gas chamber, said charging stock is gasified by hot offgases coming from said at least one burner, with a gas forming, said gas forming, upon passage through said fixed bed, is extracted from said furnace arrangement as a product gas, the improvement comprising:

injecting an oxygen-containing gas into the furnace space present above said fixed bed and filled by said product gas, and burning a slight portion of said product gas.

2. A process as set forth in claim 1, wherein a product gas exhaust duct is provided in said furnace arrangement and the temperature of said product gas is measured in said product gas exhaust duct, said oxygen-containing gas being fed in an amount being function of the temperature measured.

3. A process as set forth in claim 1, wherein said charging stock to be gasified and forming said fixed bed is comprised of waste products and a further fixed bed is provided so as to be covered by said fixed bed of said charging stock to be gasified in the direction towards said primary gas chamber, said gas forming passes through said further fixed bed before being extracted, said oxygen-containing gas is injected into the furnace space present above said further fixed bed and filled by said product gas, and a slight portion of said product gas passed through said further fixed bed is burnt.

4. A process as set forth in claim 1, wherein 0.5 to 8% by volume of said product gas is burnt within said furnace arrangement.

5. In a furnace arrangement to be used for gasifying fuels with oxygen or oxygen-containing gases and optionally steam, by providing a fixed bed of charging stock, forming a gas by gasifying said charging stock, extracting said gas upon passage through said fixed bed as a product gas and burning a slight portion of said product gas present above said fixed bed upon injection of an oxygen-containing gas, said furnace arrangement including a furnace adapted to receive solid charging stock and including a shaft-like furnace compartment, a primary gas chamber provided in communication with said shaft-like furnace compartment via a passage on its lower end to accommodate said fixed bed, a burner provided in said primary gas chamber and including supply means for oxygen or oxygen-containing gas and for fuels and optionally steam, a product gas exhaust duct provided on the upper end of said shaft-like furnace compartment, and a supporting bottom arranged on the lower end of said furnace and including an overflow weir, the improvement comprising:

at least one gas feed means for said oxygen-containing gas leading into said shaft-like compartment in the upper region thereof, a control valve provided in said gas feed means, a temperature probe provided in said product gas exhaust duct, and a control unit connecting said control valve with said temperature probe.

6. An arrangement as set forth in claim 5, wherein said gas feed means for oxygen-containing gas comprises several orifices arranged to be distributed about the periphery of said furnace and leading into said furnace.

7. An arrangement as set forth in claim 6, wehrein said several orifices are disposed at different height levels of said furnace.

8. A process as set forth in claim 2, wherein 0.5 to 8% by volume of said product gas is burnt within said furnace arrangement.

9. A process as set forth in claim 3, wherein 0.5 to 8% by volume of said product gas is burnt within said furnace arrangement.

* * * * *